US011539167B2

(12) United States Patent
Volkov

(10) Patent No.: US 11,539,167 B2
(45) Date of Patent: Dec. 27, 2022

(54) ADJUSTABLE PUSH ON CONNECTOR/ADAPTOR

(71) Applicant: Carlisle Interconnect Technologies, Inc., St. Augustine, FL (US)

(72) Inventor: Peter Volkov, Torrance, CA (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

(21) Appl. No.: 17/024,219

(22) Filed: Sep. 17, 2020

(65) Prior Publication Data

US 2022/0085549 A1 Mar. 17, 2022

(51) Int. Cl.

| | |
|---|---|
| ***H01R 13/635*** | (2006.01) |
| ***H01R 9/05*** | (2006.01) |
| ***H01R 13/05*** | (2006.01) |
| ***H01R 13/11*** | (2006.01) |
| ***H01R 24/54*** | (2011.01) |

(52) U.S. Cl.

CPC ..... *H01R 13/635* (2013.01); *H01R 9/0527* (2013.01); *H01R 13/052* (2013.01); *H01R 13/11* (2013.01); *H01R 24/542* (2013.01)

(58) Field of Classification Search

None

See application file for complete search history.

(56) References Cited

U.S. PATENT DOCUMENTS

| | | | |
|---|---|---|---|
| 1,347,738 | A | 7/1920 | Douglas |
| 3,275,970 | A | 9/1966 | Bengt et al. |
| 3,416,125 | A | 12/1968 | Theve |
| 4,508,405 | A | 4/1985 | Damon et al. |
| 4,740,746 | A | 4/1988 | Pollock et al. |

(Continued)

FOREIGN PATENT DOCUMENTS

| | | | |
|---|---|---|---|
| FR | 2462797 | A1 | 2/1981 |
| KR | 102122687 | B1 | 6/2020 |

OTHER PUBLICATIONS

European Patent Office; Search Report and Written Opinion in related International Patent Application No. PCT/US2021/050594 dated Jan. 5, 2022; 16 pages.

(Continued)

*Primary Examiner* — Ross N Gushi

(74) *Attorney, Agent, or Firm* — Wood Herron & Evans LLP

(57) ABSTRACT

A connector or adaptive connector includes a first subassembly and a second subassembly with each subassembly including a center conductor and terminating at one end in a termination portion forming a connector portion. The subassemblies interface with each other to slide with respect to each other. A spring acts on each of the subassemblies to bias the subassemblies to slide away from each other and a sleeve contains the subassemblies and spring, the sleeve securing at least one of the subassemblies while allowing movement of the other of the subassemblies in the sleeve for varying the length of the connector. Each subassembly center conductor includes a respective portion of an electrical contact that cooperate to form a center conductor for the connector. The portions of the electrical contact are configured to slide relative to each other when the connector varies in length for maintaining an electrical signal path through the connector.

14 Claims, 8 Drawing Sheets

(56) References Cited

U.S. PATENT DOCUMENTS

| | | | | |
|---|---|---|---|---|
| 4,789,351 | A | 12/1988 | Fisher, Jr. | |
| 5,076,794 | A | 12/1991 | Ganthier | |
| 5,329,262 | A | 7/1994 | Fisher, Jr. | |
| 5,727,954 | A | 3/1998 | Kato et al. | |
| 5,746,619 | A | 5/1998 | Harting | |
| 5,936,421 | A * | 8/1999 | Stowers | G01R 15/12 324/750.27 |
| 6,053,777 | A | 4/2000 | Boyle | |
| 6,247,939 | B1 | 6/2001 | Bestul et al. | |
| 6,464,511 | B1 | 10/2002 | Watanabe et al. | |
| 6,776,668 | B1 | 8/2004 | Scyoc et al. | |
| 6,844,749 | B2 | 1/2005 | Sinclair | |
| 7,077,697 | B2 | 7/2006 | Kooiman | |
| 7,416,418 | B2 | 8/2008 | Berthet et al. | |
| 7,922,529 | B1 | 4/2011 | Meurer | |
| 7,950,927 | B2 | 5/2011 | Kazama et al. | |
| 7,972,173 | B1 | 7/2011 | Hyzin et al. | |
| 8,460,010 | B2 | 6/2013 | Kimura | |
| 8,888,527 | B2 | 11/2014 | Chastain | |
| 9,039,448 | B2 | 5/2015 | Mason et al. | |
| 9,059,545 | B2 | 6/2015 | Mason et al. | |
| 9,689,897 | B2 | 6/2017 | Rathburn | |
| 9,979,132 | B1 * | 5/2018 | Flaherty, IV | H01R 13/7032 |
| 10,006,939 | B2 | 6/2018 | Shi | |
| 10,069,257 | B1 | 9/2018 | Soubh et al. | |
| 10,181,687 | B1 | 1/2019 | Peng et al. | |
| 11,156,637 | B2 | 10/2021 | Kister et al. | |
| 11,171,434 | B2 | 11/2021 | Narumi | |
| 11,189,945 | B2 | 11/2021 | Koshiishi et al. | |
| 2003/0006787 | A1 | 1/2003 | Kazama | |
| 2003/0082942 | A1 | 5/2003 | Wlos | |
| 2010/0178798 | A1 | 7/2010 | Rosenberger | |
| 2010/0267291 | A1 | 10/2010 | Chabineau-Lovgren | |
| 2014/0322969 | A1 | 10/2014 | Palinkas | |
| 2015/0180182 | A1 | 6/2015 | Tatzel et al. | |
| 2015/0295359 | A1 | 10/2015 | Vinther et al. | |
| 2016/0154024 | A1 | 6/2016 | Miyagawa | |
| 2017/0142824 | A1 | 5/2017 | Puzella et al. | |
| 2018/0131153 | A1 | 5/2018 | Flaherty, IV | |
| 2018/0316103 | A1 | 11/2018 | Flaherty, IV | |

OTHER PUBLICATIONS

Micro-Mode Products, Inc.; Product Drawing for MMSP Compressible Bullet; 1 page.

* cited by examiner

ADJUSTABLE PUSH ON CONNECTOR/ADAPTOR

TECHNICAL FIELD OF THE INVENTION

The present invention is directed to push on connectors and specifically to push on connectors to interface between electrical circuit boards and components.

BACKGROUND OF THE INVENTION

Push on connectors, such as sub-miniature push-on connectors (SMP) are coaxial connectors used in a wide variety of electrical applications. They can be used from DC frequencies all the way up to microwave frequencies at 40 GHz and above, for example. The SMP interface is commonly used in miniaturized high frequency coaxial modules and is offered in both push-on and snap-on mating styles. The SMP family of connectors addresses small package design needs and can be utilized as a shielded interconnect for high data rate applications or in a board-to-board system coupling together printed circuit boards (PCB) and other electronic components.

The SMP interface has had various evolutions and reductions in size, including the SMPM platform, and most recently the SMPS platform. The SMPS interface is an emerging technology for current applications. Each generation operates at higher frequencies, allowing for higher data transmission rates. Furthermore, the smaller size of the SMPS generation allows for higher packaging and signal density. However, despite the desirable size and density considerations, use of the existing SMPS platform and connectors has not been significant in component-to-component applications, such as in PCB-to-PCB applications.

Therefore, many needs still exist in the area of connector technology regarding providing an efficient and robust electrical connection in high density, for interfacing between electronic components, such as printed circuit boards. There is further a need for a connector or adaptor platform that provides a good high frequency connection in those applications wherein the spacing between components is variable.

SUMMARY OF THE INVENTION

A connector or adaptive connector includes a plurality of subassemblies that interface together in a sliding or adjustable fashion for adapting to interface conditions between components being connected. The connector includes a first subassembly including a center conductor and which terminates at one end in a termination portion forming a connector portion that connects to a component connector. A second subassembly includes a center conductor and also terminates at one end in a termination portion forming a connector portion that connects to another component connector. The subassemblies interface with each other to slide with respect to one another. A spring acts on each of the subassemblies to bias the subassemblies to slide away from each other and a sleeve contains the subassemblies and spring to secure at least one of the subassemblies while allowing movement of the other of the subassemblies in the sleeve for varying the length of the connector. Each subassembly center conductor includes a portion of an electrical contact configured to engage with another portion of the electrical contact of the other subassembly to form a center conductor for the connector. The portions of the electrical contact are configured to slide relative to each other when the connector varies in length for maintaining an electrical signal path through the connector.

DETAILED DESCRIPTION OF THE INVENTION

Figure 1:
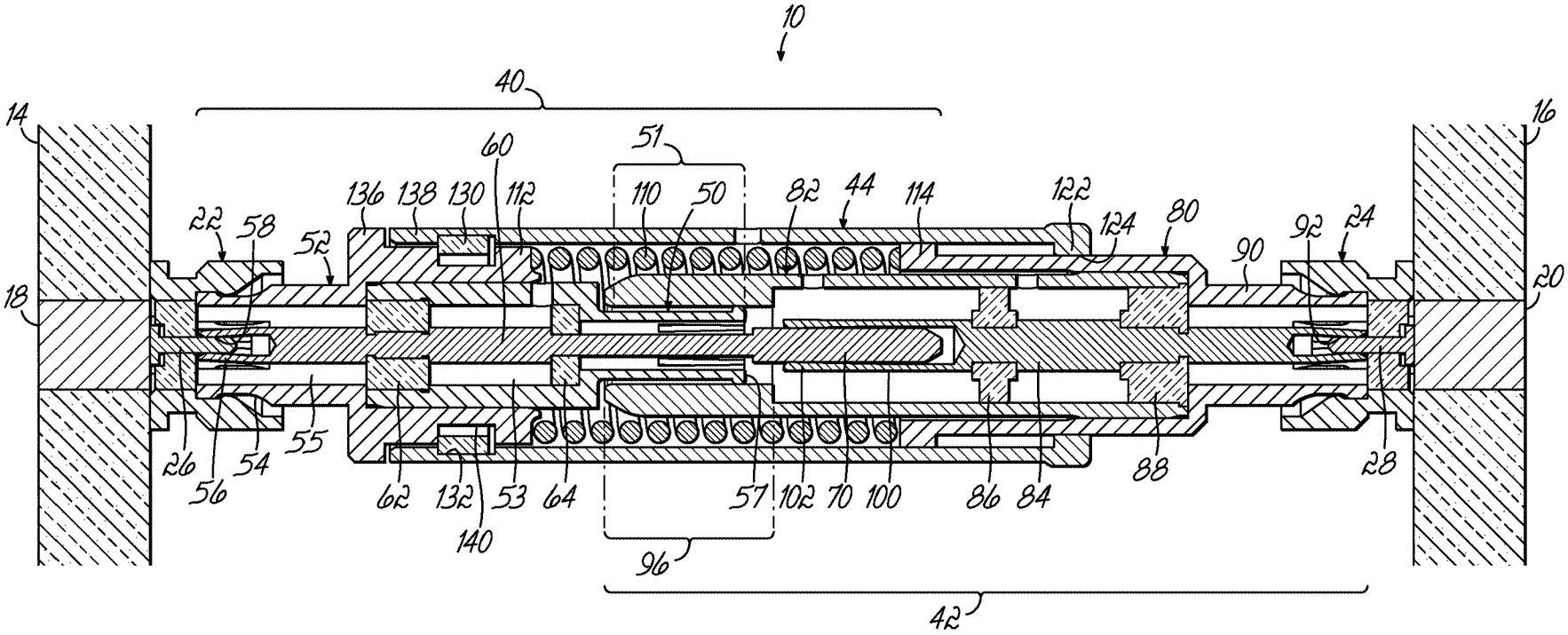
FIG. 1 is cross-sectional side view of a connector/adaptor in accordance with an embodiment of the invention shown connecting electronic systems and components.

FIG. 1 illustrates a connector/adaptor in accordance with one embodiment of the invention. Such connectors, as described herein providing connection locations at opposite ends thereof are used to couple together components, such as printed circuit boards or other signal carrying or signal handling components. Therefore, such connectors are often referred to as adaptors. Herein, the invention will be referred to generically as a connector or as an adaptive connector when connecting with two other component connectors as it provides an electrical connection between two signal carrying components, but the nomenclature of the connector or adaptor is not limiting with respect to the invention.

Figure 6:
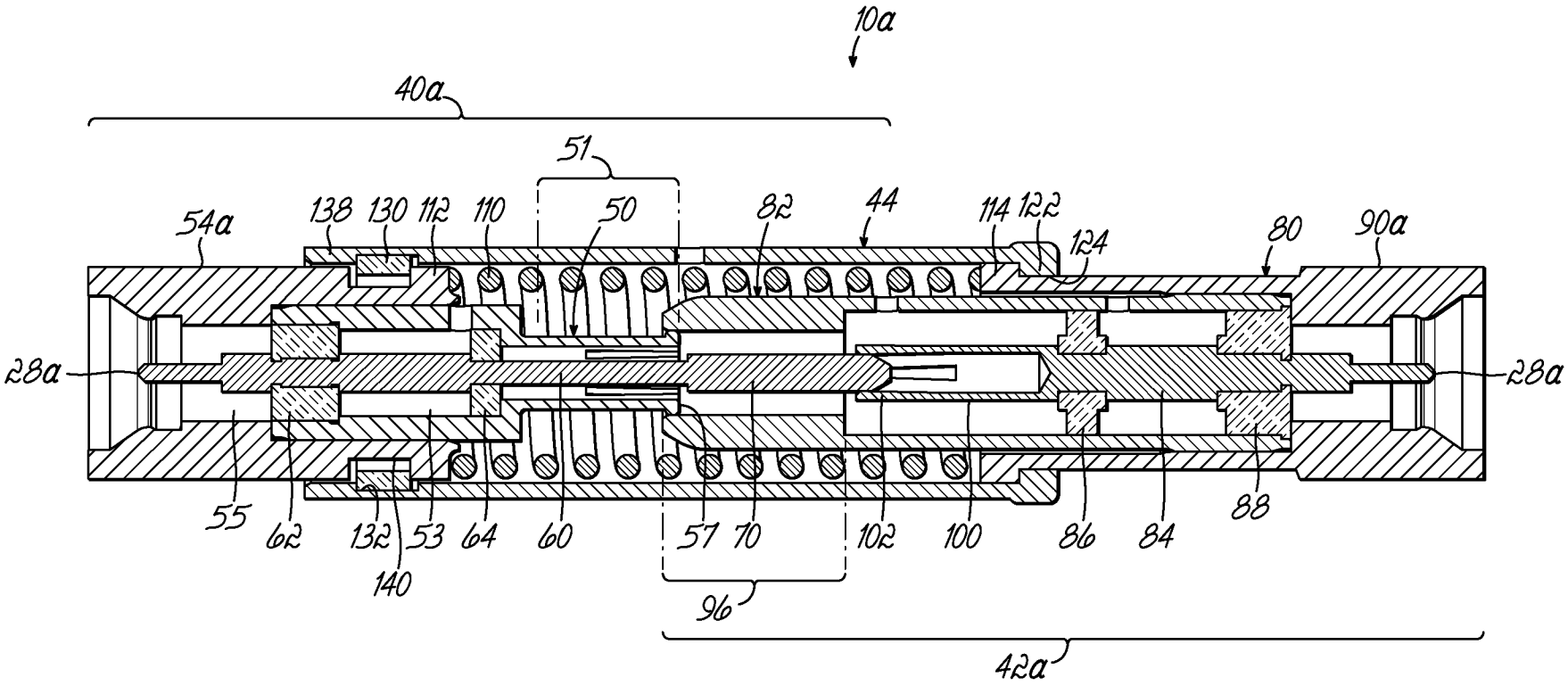
FIG. 6 is cross-sectional side view of a connector/adaptor in accordance with another embodiment of the invention.
Figure 7:
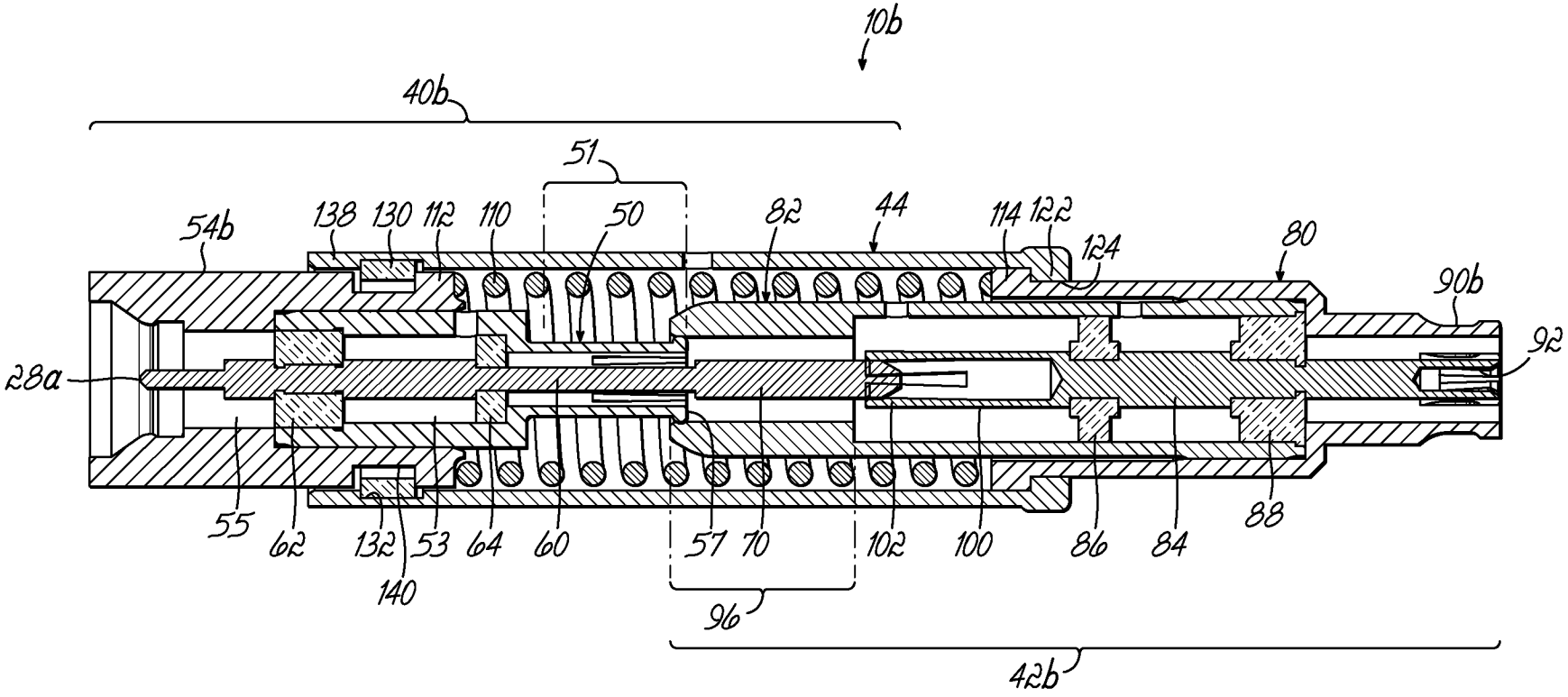
FIG. 7 is cross-sectional side view of a connector/adaptor in accordance with another embodiment of the invention.
Figure 8:
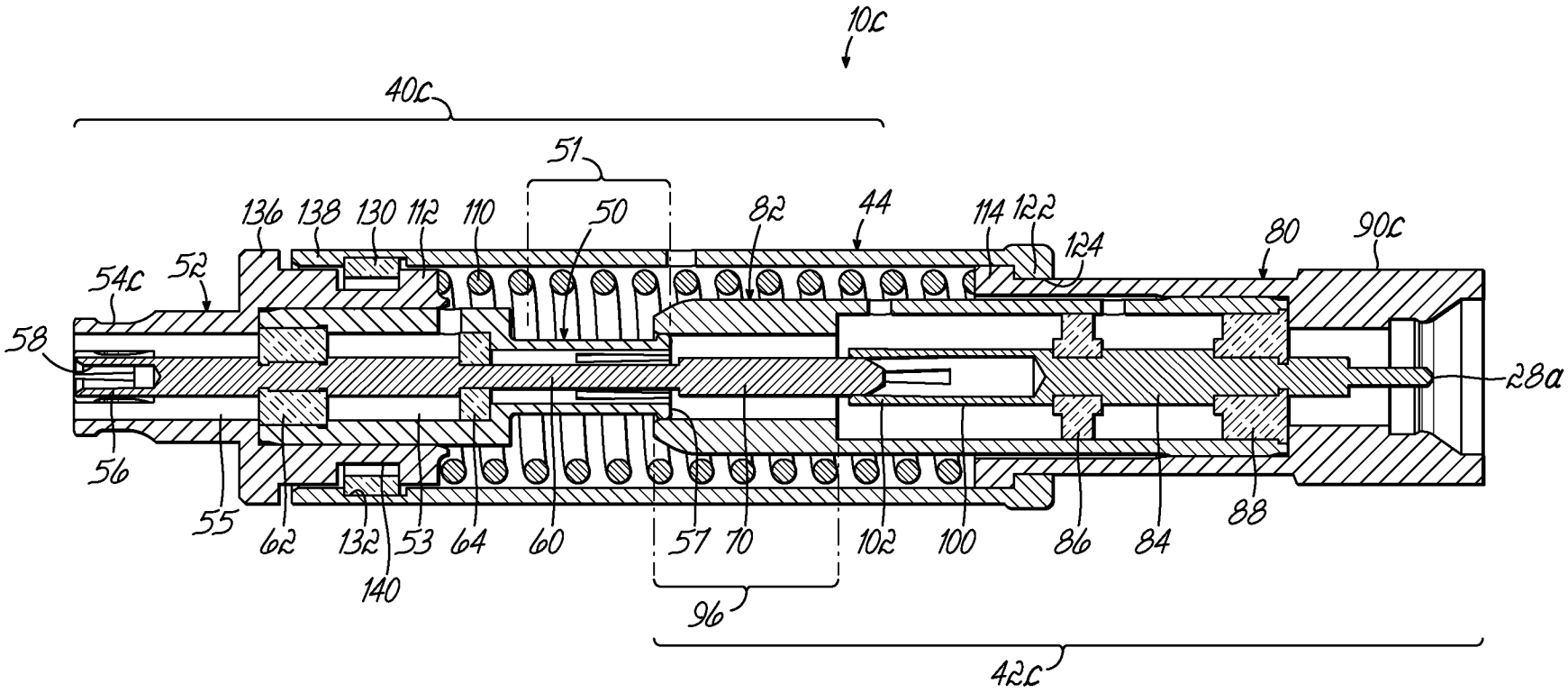
FIG. 8 is cross-sectional side view of a connector/adaptor in accordance with another embodiment of the invention.

Specifically, FIG. 1 illustrates a connector or connection system 10 which provides an electrical interface between two signal carrying components 14, 16, such as for example, printed circuit boards. Each of the printed circuit boards includes one or more electrical signal paths 18, 20 that terminate in an appropriate connector 22, 24 or connector portion. In the embodiment illustrated in FIG. 1, the connectors 22, 24 are considered male connectors as they each incorporate a conductive center pin 26, 28 that is electrically coupled in an appropriate fashion, with one of the signal paths 18, 20 of components 14, 16 as shown. Components 14, 16 and their respective signal paths 18, 20 and terminal connectors 22, 24 are not limiting with respect to the invention. The various signal carrying or signal handling components can take various different forms and may be coupled together utilizing the connector 10 of the invention. Furthermore, while FIG. 1 illustrates components 14, 16 that terminate in male connectors, one or more of the terminal connectors 22, 24 might be a female connector. Alternative embodiments of the connector or adapter 10, as illustrated in FIGS. 6-8, might be implemented providing different combinations of male and female terminations to connector 10 for coupling with the appropriate component connectors 22, 24 of components 14, 16 to provide an appropriate electrical path between the components. The connector 10 of the invention operates with the one or more components 14, 16 and the respective connectors 22, 24 of those components to form a larger electrical system for handling and processing signals.

Connector 10 of the present invention incorporates a plurality of subassemblies that interact in a varying form to provide a connector having a varying effective length. The subassemblies include a first subassembly 40 and a second subassembly 42 that cooperate and move together within a sleeve 44 that encompasses and contains portions of the subassemblies as shown in FIG. 1 and as further illustrated in FIGS. 2-5. The embodiment as discussed herein and shown in FIGS. 1-5 implements termination portions that form connector portions that are each female connector portions or connectors for interfacing with male connectors 22, 24 as illustrated. However, the additional embodiments as illustrated in FIGS. 6-8 incorporate similar subassemblies and components as described herein for the embodiment shown in FIGS. 1-5 but with different termination configurations.

Figure 2:
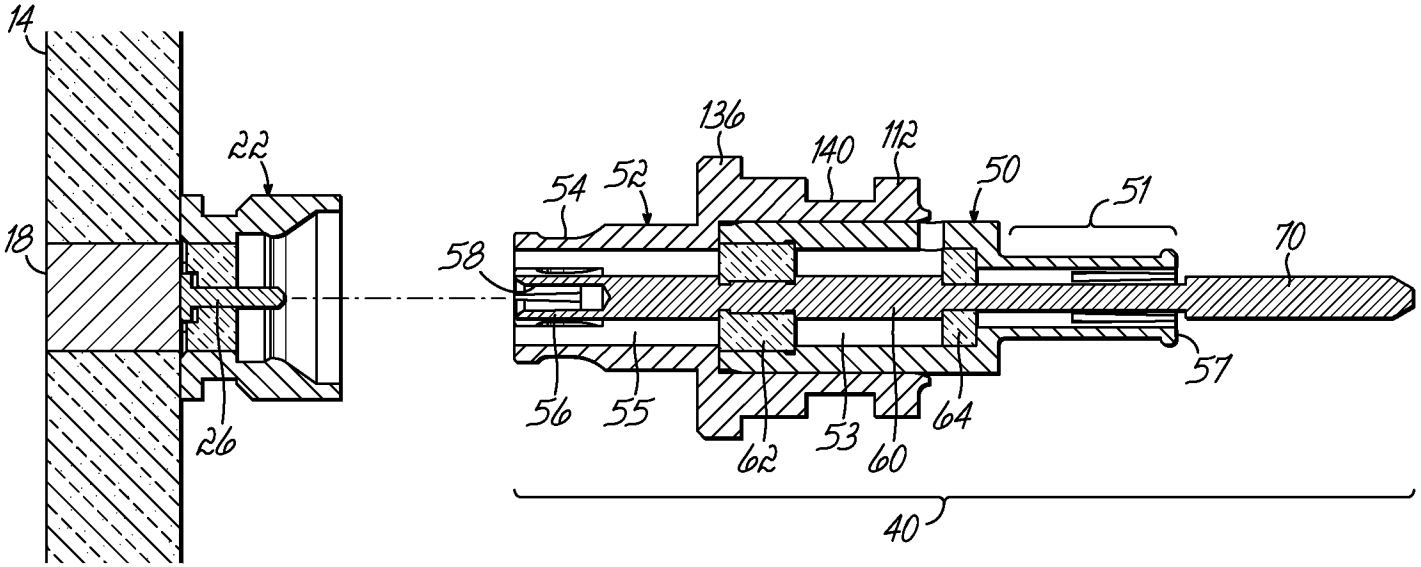
FIG. 2 is an exploded cross-sectional side view of a portion of the connector/adaptor of FIG. 1.

Specifically, turning to FIG. 2, the first subassembly 40 is illustrated and incorporates an insert portion or insert 50 that fits into a body portion or body 52. The insert 50 and body 52 are formed of an appropriate conductive material, such as gold plated beryllium copper. The body 52 includes a termination portion 54 that forms a connector or connector portion to interface with the component connector 22. In one embodiment of the invention, the connector portion 54 is configured to form one half of a push-on connector system, such as an SMPS connector. However, the connector portion 54 might also be configured into the form of an SMP or an SMPM type of connector or other push-on connector. To that end, the connectors 22, 24 would also then be an appropriately configured SMPS or other push-on connector in order to provide proper electrical coupling and a signal path for signals between the components 14, 16. In the embodiment as illustrated in FIG. 2, when the component connector 22 is a male connector, the connector portion 54 of the first body 52 incorporates a female center conductor portion or socket 56 as illustrated. In the exemplary embodiment of an SMPS connector 54, the socket 56 will be formed by a plurality of spring loaded fingers that form the aperture 58 and socket 56 that contacts and grips the pin 26 of the male connector 22, 24. FIG. 1 shows connector portion 54 properly seated within connector 22 for engagement between pin 26 and aperture 58 of the female socket 56 formed by the center conductor 60 as discussed herein.

As shown in FIG. 2, connector 10 incorporates a center conductor 60 that is seated within insert 50 and extends through body 52 to terminate at female portion 54. The end of the center conductor forms the socket 56. Center conductor 60 is seated in the center of insert 50 with appropriate electrically insulative sleeves 62, 64 are configured and dimensioned to ensure proper alignment of the center conductor 60 within the overall subassembly 40. The insulative sleeves may be formed of a suitable electrically insulating material, such as polytetrafluoroethylene (PTFE), to isolate the center conductor from the insert and first subassembly 40. Center conductor 60 is formed of an electrically conductive material, such as gold plated beryllium copper, and provides a signal path through subassembly 40 to the connector portion 54, and specifically to the female socket 56. As noted, connector portion 54 and center conductor socket 56 are appropriately configured to form a female SMPS connector in the illustrated embodiment, but may take other forms as appropriate depending upon the connector 22 of component 14. The center conductor 60 and sleeves 62, 64 may be appropriately press fit into insert 50 to form a coaxial configuration for the first subassembly 40. Insert 50 then fits into body 52 to form the first subassembly 40 so that the insert presents the center conductor with the connector portion at an end of the connector in a coaxial arrangement. The center conductor 60 also incorporates a pin portion 70 opposite the socket 56. As illustrated in FIG. 1, the pin portion 70 forms one part of a sliding electrical contact and engages the appropriate center conductor of the second subassembly 42 to provide a signal path of varying length through connector 10.

Figure 3:
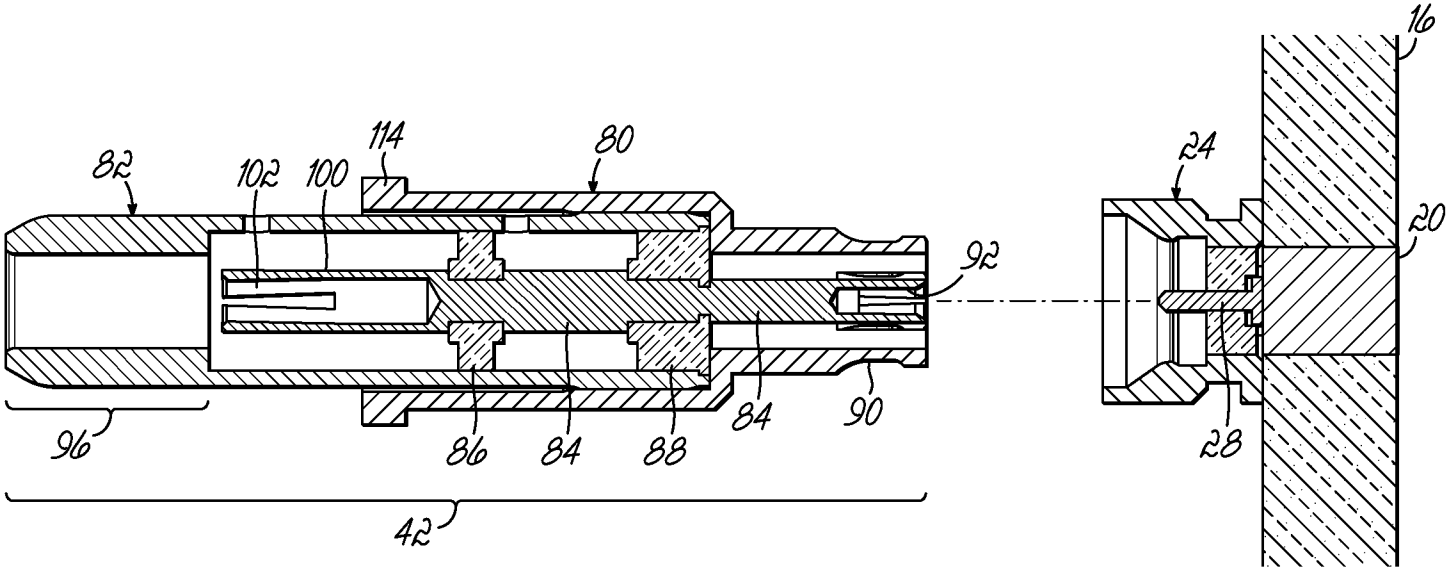
FIG. 3 is an exploded cross-sectional side view of another portion of the connector/adaptor of FIG. 1.

Referring to FIG. 3, the second subassembly 42 is illustrated and includes a body portion or body 80 as well as an insert portion or insert 82 that fits into the body 80. Like the first subassembly 40, the insert 82 and body 80 of the second subassembly are dimensioned so as to provide a friction fit, wherein the insert 82 engages with the body 80 at a position along its length to form the subassembly, upon insertion into the body 80. Subassembly 42 also incorporates a center conductor 84 made of an appropriate electrically conductive material, such as gold plated beryllium copper. The center conductor 84 is held in position within insert 82 using insulative sleeves 86, 88 made of an electrically insulative material such as polytetrafluoroethylene (PTFE). The center conductor is held and positioned generally coaxially within the insert 82 to provide proper alignment between the first subassembly and the second subassembly and also alignment with connector 24 on component 16. In the embodiment illustrated in FIG. 3, the body 80 includes a termination portion 90 that is configured to interface with connector 24. Specifically, the termination portion 90 is configured to act as a female portion of an SMPS connector. To that end, the center conductor forms an appropriate socket 92, similar to socket 56. The insert presents the center conductor with the connector portion at an end of the connector in a coaxial arrangement. The socket 92 is formed therein for receipt of the pin 28 of connector 24. That is, for the embodiment as illustrated in FIGS. 1-5, wherein the connector 10 incorporates female connector terminations at each end, the termination portions 54 and 90 are similarly formed as are the sections of the respective center conductors 60 and 84 that determine the male or female configurations for the termination portions.

Referring again to FIG. 1, the first subassembly 40 and second subassembly 42 are configured to couple together in an expandable and adjustable fashion in accordance with aspects of the invention to provide a proper connection and interface between components 14, 16, such as printed circuit boards. The connector 10 allows for longitudinal adjustment of the subassemblies with respect to each other and variation in the length of the overall connector 10 in order to ensure good contact between the components 14, 16 that may have some axial and radial variations due to manufacturing tolerances. The present invention further provides an SMPS connector platform that may be utilized with stacked printed circuit boards and further provides developers with a product that will allow for denser packaging in the connection scheme between printed circuit boards or other electrical components in which a terminal connector 22, 24 might be used.

To that end, the connector insert 82 of the second subassembly includes an interface portion 96 that is configured to accept another respective interface portion 51 of the first subassembly as illustrated in FIG. 2. Referring again to FIG. 1, the interface portion 51 of the first subassembly 40 is received by the interface portion 96 of the second subassembly 42. Interface portions 51 and 96 are configured to provide an alignment between pin portion 70 of a sliding electrical contact and a respective socket 100 of the sliding electrical contact. The socket 100 incorporates a plurality of spring fingers 102 which hold and grip pin portion 70 to provide a sliding electrical contact and connection between center conductor 60 and center conductor 84 of the subassemblies and thus provide a continuous signal path through connector 10. The interface portions 51 and 96 are configured and dimensioned to maintain the desired alignment of the portions 70, 100 of the sliding contact as the length of the connector is varied for use in different applications and to span variable distances between components, such as stacked PCB's. The length of pin portion 70 and socket 100 is configured in order to provide longitudinal movement of pin portion 70 within socket 100 while still maintaining a continuous electrical connection between center conductors 60 and 84. More specifically, longitudinal adjustment and length variation of the connector 100 is facilitated by the sliding contact interface between portions 70 and socket 100 and the related movement of interface portion 51 of the first subassembly within the interface portion 96 of the second subassembly.

In accordance with another feature of the present invention, in order to ensure proper seating and connection of the push on connector 10, the connector incorporates a spring bias for biasing the first subassembly away from the second subassembly in order to provide a biasing force to drive the respective termination portions 56 and 90 into the respective connectors 22, 24. This ensures a proper seating of the various male pins of the connectors within the sockets 56, 92 of the termination portions 54 which are configured in the embodiment shown in FIGS. 1-5 as female termination portions. As discussed further herein, one or more of those termination portions might be a male termination portion coupling with the respective female connector on one of the components 14, 16.

To provide the spring bias, a spring 110 is coupled between the subassemblies 40 and 42. Specifically, the body 52 of the first subassembly and the body 80 of the second subassembly fit inside the length of the spring and each includes a radial shoulder or shoulder portion 112, 114, respectively that extend around the body and capture the spring 110 therebetween. As illustrated in FIG. 1, Spring 110 is shown disposed between each of the subassemblies, and specifically disposed between each of the bodies and the respective shoulder 112, 114 around the interfaced subassemblies. To that end, the spring 110 is dimensioned to allow the subassemblies to move inside of the spring under its bias on the respective bodies 52, 80. As shown in FIG. 1, the spring 110 biases the bodies 52, 80 away from each other in the connector 110 to an open or extended position of the connector.

Figure 4:
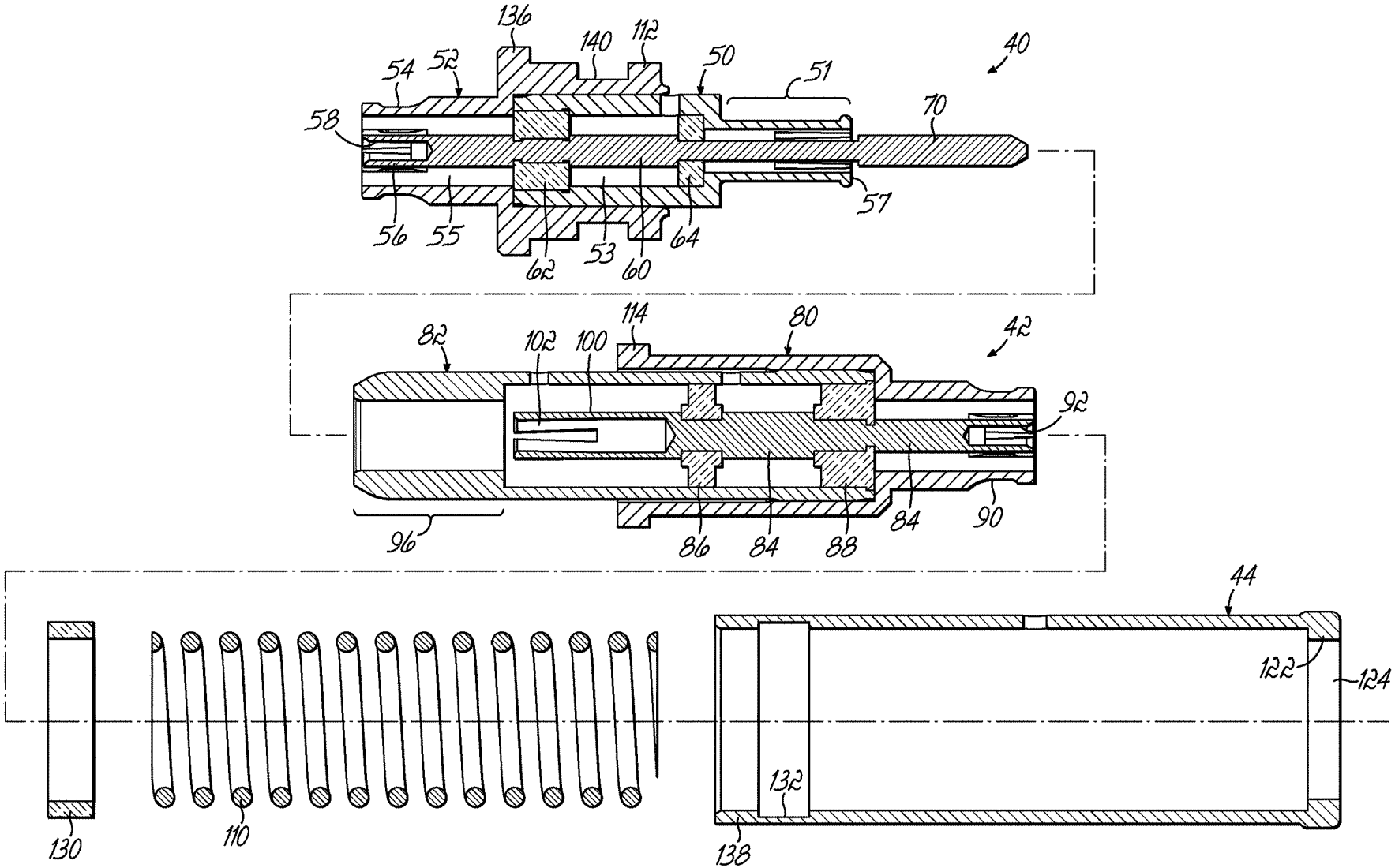
FIG. 4 is an exploded cross-sectional side view of the entire connector/adaptor of FIG. 1.
Figure 5:
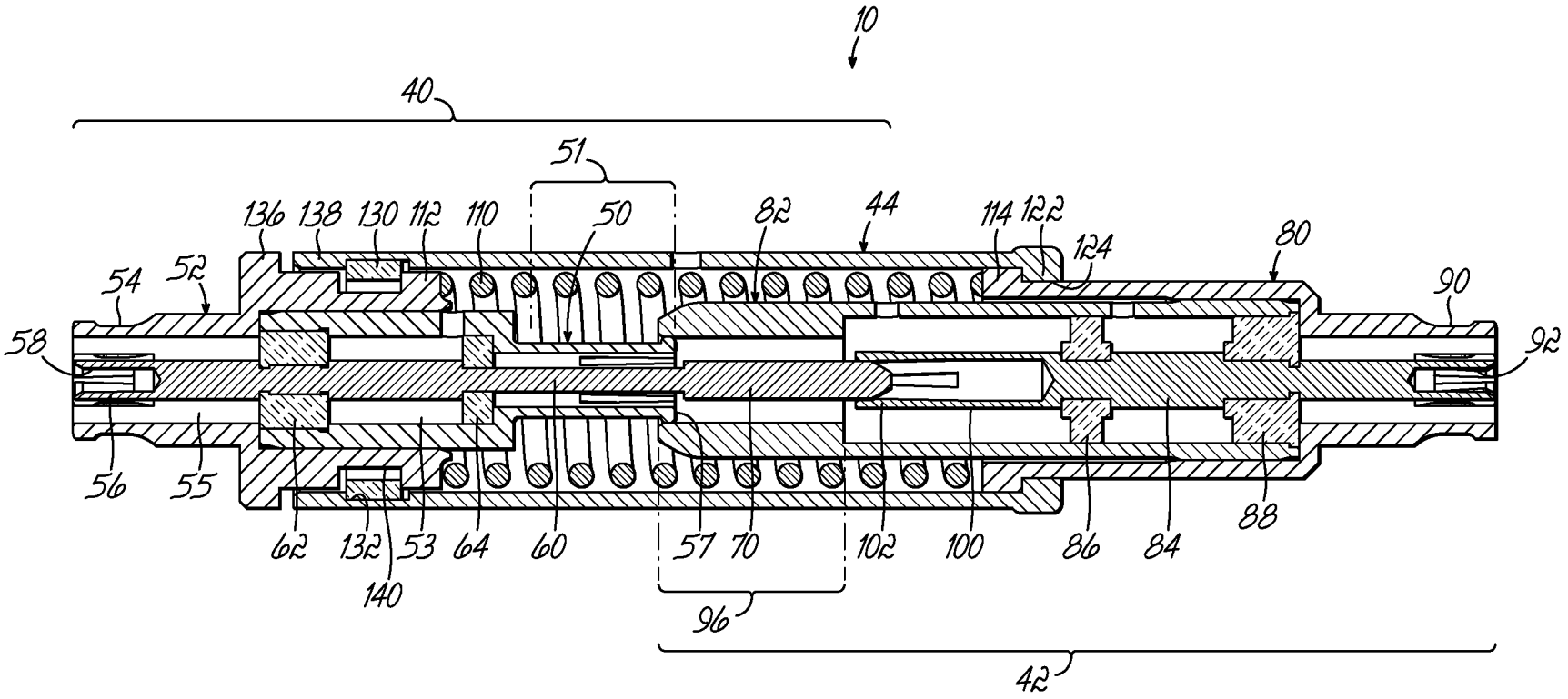
FIG. 5 is cross-sectional side view of a connector/adaptor of FIG. 1, in a state of assembly.

For containing the various subassemblies and forming the housing for the connector 10, sleeve 44 is configured to fit around both the subassemblies and the spring 110. In that way, the subassemblies and the spring are captured and move in an axial fashion in the sleeve to vary the length of the connector 10. Referring to FIG. 4, in one end of the sleeve, the second subassembly 42 is contained by an inwardly extending flange portion 122 that captures the shoulder 114 of the second subassembly 42. Specifically, as illustrated in FIG. 4, the second subassembly 42 extends into the sleeve 110 and part of the body 80 extends out of an aperture 124 formed in the end of the sleeve 110. The aperture 124 is smaller than the outer diameter of the shoulder 114 in body 80 of the second subassembly which thus prevents the second subassembly from extending all the way out of the aperture 124 in the extended position of the connector. As illustrated in FIG. 5, when the connector is in a fully extended position, the shoulder 114 abuts against the flange 122 of the sleeve 110.

For containing the first subassembly 40 within sleeve 110, a retaining ring 130 is implemented and fits within a ring slot 132 formed on an inner surface of the sleeve 110 proximate the end of the sleeve opposite aperture 124. The ring 130 engages slot 132 that is formed around the sleeve and also engages a radial slot formed around the body 52 and bordered on one side by the shoulder 112. The shoulder 112 extends radially outwardly on the body 52 of the first subassembly 40. As shown in FIG. 4, the first subassembly 40 also fits inside of the spring 110 to slide in that spring. The body 52 of the first subassembly also includes an outer shoulder portion or shoulder 136 that sits rearwardly of the termination portion 54 of the body. The shoulder 136 abuts against an end 138 of the sleeve 110 to close the end of the sleeve when the first subassembly 40 has been secured therein. Specifically, the retaining ring 130 engages slot 132 and also engages the radial slot 140 formed around the body 52 to secure the body and the first subassembly 40 in the sleeve. As illustrated in FIG. 1, the retaining ring 130 simultaneously engages both the slot 132 and sleeve 110 and the radial slot 140 within the body 52 of the first subassembly. Such engagement generally secures or anchors the first subassembly 52 within the sleeve to generally prevent movement of that first subassembly in the sleeve. There may be some sliding or movement of the first subassembly based on tolerances of the ring and slots 132, 140, but generally the first subassembly is secured. By securing the first subassembly, the second subassembly is secured in the spring and sleeve as well. The body 52 closes the end of the sleeve. However, the second subassembly can move freely in the axial direction in the sleeve and spring and partially extends out of the sleeve. In that way, connector 10 is contained within sleeve 44 and allows for axial movement of one of the subassemblies with respect to the other subassembly inside of the sleeve to provide the varying length of the connector.

That is, the connector 10 includes a first subassembly and a second subassembly with each subassembly terminating at one end in a termination portion forming a connector portion. The spring acts on each of the subassemblies to bias the subassemblies away from each other while the sleeve contains the first subassembly, second subassembly and spring together as a connector. The sleeve secures at least one of the subassemblies while allowing movement of the other of the subassemblies in the sleeve for varying the length of the connector. Each subassembly includes a portion of a sliding electrical contact positioned opposite the respective termination portion of the subassembly and the sliding electrical contact portions are configured to slide relative to each other when the connector varies in length for maintaining an electrical signal path through the connector.

Referring to FIGS. 4 and 5, to assemble connector 10, the various subassemblies may be assembled and then engaged and then the entire system secured within sleeve 44. Specifically, the retaining ring 130 can be slid into the respective slot 140 in body 52 of the first subassembly. Next, the center conductor 60 may be secured with the insulative sleeves 62, 64 inside of insert 50 for securing the center conductor in a coaxial orientation with respect to the insert 50. Then, the insert and center conductor may be press fit into the body 52. It may be appreciated that the various inserts and bodies have circular outer diameters and inner diameters to provide for proper frictional engagement between the bodies and subassemblies as well as engagement and alignment within the tubular sleeve 44. To that end, the outer diameter of the insert 50 is dimensioned so as to provide a proper friction fit or press fit into an internal aperture formed within body 52 to receive the insert as shown in FIG. 2. The insert 50 also includes an internal space 53 that aligns with an internal space 55 within the body when the insert 50 is received into the body 52. The center conductor 60 extends through the spaces 53, 55 such that the socket 56 and aperture 58 are presented generally flush with the end of the termination portion 54 to provide a coaxial connector arrangement to engage connector 22 as seen in FIG. 1. At the opposite end of the first subassembly, pin portion 70 of the sliding contact extends through an end 57 of the insert 50 for proper engagement with the second subassembly 42.

To assemble the second subassembly, referring to FIG. 3, the center conductor 84 is assembled into the insert 82 utilizing the insulative sleeves 86, 88. The center conductor is coaxially located in the cylindrical insert 82. The center connector is also positioned so that the socket 92 and its aperture are appropriately positioned flush with the termination portion 90 to form the connector end for proper engagement with connector 24 and pin 28. As noted, the embodiment as illustrated in FIGS. 1-5 assumes termination portions that are female termination portions for the connector 10. As discussed further herein, the center conductor 84 may take a different form depending upon whether the termination portion of the connector is male or female.

The opposing end of the center conductor 84 includes a plurality of spring fingers 102 that form the socket 100 and such spring fingers are positioned proximate the end of the insert opposite to the termination portion 90 of the body. Specifically, the spring fingers 102 and socket 100 are positioned proximate to interface portion 96 of the insert that interfaces with the respective interface portion 51 of the first subassembly when the two subassemblies are engaged in the connector. Once the insert has been assembled with the center conductor, the second insert 42 is press fit into body 80 for forming the subassembly as shown in FIG. 3. Then, the spring 110 may be slid over the first subassembly to abut against shoulder 112 as shown in FIG. 1. Then, the second subassembly is engaged with the first subassembly in the spring by sliding the interface portion 51 of the first subassembly into the interface portion 96 of the second subassembly such that the pin portion 70 engages socket 100 to form a sliding electrical contact. Through the movement of the second subassembly 42 within the sleeve and spring, the pin portion 70 moves in the socket and is gripped by the spring fingers 102 for a continuous signal path through the connector 10.

The sleeve 44 is then slid over the second subassembly and the first subassembly and the spring as illustrated in FIG. 5. The flange 122 engages shoulder 114 of the second subassembly to contain the subassembly, and portions of the body 80 and insert 82 protrude from an end of the sleeve 44 to slide in length in the sleeve. As illustrated in FIG. 5, the retaining ring 130 in the slot 140 of the body 52 of the first subassembly has to be compressed to allow sleeve 44 to slide over the subassembly so that the retaining ring 130 may engage slot 132 formed around the sleeve 44. The expanded ring engages the radial slots 132, 140. In that way, the first subassembly is locked into the sleeve as shown in FIG. 1 with the spring 110 slightly compressed and acting upon shoulders 112 and 114 of the respective bodies of the subassemblies in order to drive the second subassembly 42 away from the first subassembly 40 in the sleeve so that the connector is in an extended position as shown in FIG. 5. The spring 110 may be compressed in order to vary the length of the overall connector 110 and thus adapt to different spacings and orientations of components 14, 16 and the connectors 22, 24 thereon, such as different spacings between PCB's as shown in FIG. 1. That is, the connector 110 may be compressed by pushing the second subassembly 42 into the sleeve and properly seating both of the termination portions 56 and 90 within mating connectors 22, 24. The first subassembly generally remains locked into its position by the ring 130. The spring provides a push-on bias to each of the connector termination portions 90, 54 for proper seating and mating and good electrical contact through the sliding contact portions 70, 100 for the various lengths of the connector.

FIG. 6 illustrates an alternative embodiment of the invention and particularly shows a connector 10*a* that incorporates male termination portions at each end. For example, both the first subassembly 40*a* and second subassembly 42*a* incorporate termination portions 54*a* and 90*a*, respectively, that are male connector portions and thus, include generally a socket body 54*a* and a pin 28*a*. That is, in the center conductors 60, 84, the end portions are formed as pins 28*a* rather than sockets as illustrated in FIG. 1. The embodiment illustrated in FIG. 6 is similar to the embodiment illustrated in FIG. 1, wherein the termination portions 54*a*, 90*a* are in the form of SMPS connectors. In accordance with the invention, the termination portions might be configured and dimensioned appropriately to form other push on connectors, such as SMP or SMPM connectors or other suitable connector configurations for use with the invention. Connector 10*a* would be implemented with appropriate components, such as PCB's 14, 16 that include appropriate female connectors to interface with the male termination portions 54*a*, 90*a*. Other components of the connector 10*a* are similar to that as described in the embodiment of FIGS. 1-4.

FIG. 7 illustrates an alternative embodiment of the invention, wherein the first subassembly 40*b* incorporates a male termination portion 54*b* as illustrated similar to the termination portion 54*a* as illustrated in FIG. 6. The second subassembly 42*b*, on the other hand, incorporates a female termination portion 90*b* similar to that illustrated in FIG. 1. Other components of the connector 10*b* are similar to those described herein with respect to FIGS. 1-5. The termination portions interface with appropriate other male or female connectors as discussed herein.

FIG. 8 illustrates another alternative embodiment, wherein the first subassembly 40*c* incorporates a female termination portion 54*c* and a second subassembly 42*c* which incorporates a male termination portion 90*c*. The termination portions interface with appropriate other male or female connectors as discussed herein.

While the present invention has been illustrated by a description of various embodiments and while these embodiments have been described in some detail, it is not the intention of the inventors to restrict or in any way limit the scope of the appended claims to such detail. Thus, additional advantages and modifications will readily appear to those of ordinary skill in the art. The various features of the invention may be used alone or in any combination depending on the needs and preferences of the user.

What is claimed is:

1. A connector comprising:

a first subassembly including a center conductor and terminating at one end in a termination portion forming a connector portion, the center conductor fixed with respect to the end of the termination portion to form a coaxial connector portion for the first subassembly;

a second subassembly including a center conductor and terminating at one end in a termination portion forming a connector portion, the center conductor fixed with respect to the end of the termination portion to form a coaxial connector portion for the second subassembly;

the subassemblies interfacing with each other to slide with respect to each other for varying the connector length;

a spring acting on each of the subassemblies to bias the subassemblies to slide away from each other;

a sleeve containing the first subassembly, second subassembly and spring, each subassembly including a respective shoulder, the spring being captured between the shoulders for acting on each of the subassemblies in the sleeve and the sleeve securing at least one of the subassemblies while allowing movement of the other of the subassemblies in the sleeve;

the sleeve including a slot formed on an inner surface thereof proximate one end of the sleeve;

a retaining ring configured for being received in the sleeve slot, the retaining ring configured for engaging the shoulder of a subassembly for generally securing the subassembly within the sleeve;

the sleeve further including a flange portion at another end of the sleeve, a shoulder of another subassembly abutting against the flange portion for capturing the another subassembly while allowing movement of the another subassembly in the sleeve;

each subassembly center conductor including a portion of an electrical contact configured to engage with another portion of an electrical contact of the center conductor of the other subassembly and form a center conductor for the connector, the portions of the electrical contacts being configured to slide relative to each other for forming a sliding electrical contact when the connector varies in length for maintaining an electrical signal path through the center conductor for the connector.

2. The connector of claim 1 wherein each subassembly includes an interface portion, the interface portion of one of the subassemblies configured to receive the interface portion of another of the subassemblies for providing an alignment between portions of the sliding electrical contact.

3. The connector of claim 1 wherein the sliding electrical contact includes a pin portion and a socket portion to receive the pin portion, the socket portion associated with one of the subassemblies and the pin portion associated with another of the subassemblies to slide relative to the socket portion when the connector varies in length.

4. The connector of claim 1 wherein each termination portion forms at least one of a male connector portion or a female connector portion, each subassembly including a center conductor that forms at least one of a pin or a socket to match a male connector portion or a female connector portion.

5. The connector of claim 1 wherein each termination portion forms an SMPS connector portion.

6. The connector of claim 1 wherein each subassembly includes a body portion forming the connector portion and an insert portion containing the center conductor, the body portion of a subassembly configured for receiving the insert portion to present the center conductor with the connector portion at an end of the connector.

7. The connector of claim 6 wherein the insert portion presents the center conductor with the connector portion at an end of the connector in a coaxial arrangement.

8. An electrical system comprising:

a first component configured for handling an electrical signal and including a respective connector;

a second component configured for handling an electrical signal and including a respective connector;

an adaptive connector for interfacing with the respective connectors of the components and configured for passing a signal between the first and second components, the adaptive connector comprising:

a first subassembly including a center conductor and terminating at one end in a termination portion forming a connector portion, the connector portion configured for connecting to the connector of the first component;

a second subassembly including a center conductor and terminating at one end in a termination portion forming a connector portion, the connector portion configured for connecting to the connector of the second component;

the subassemblies interfacing with each other to slide with respect to each other for varying the adaptive connector length;

a spring acting on each of the subassemblies to bias the subassemblies to slide away from each other and toward the connectors of the components;

a sleeve containing the first subassembly, second subassembly and spring, each subassembly including a respective shoulder, the spring being captured between the shoulders for acting on each of the subassemblies in the sleeve and the sleeve securing at least one of the subassemblies while allowing movement of the other of the subassemblies in the sleeve;

the sleeve including a slot formed on an inner surface thereof proximate one end of the sleeve;

a retaining ring configured for being received in the sleeve slot, the retaining ring configured for engaging the shoulder of a subassembly for generally securing the subassembly within the sleeve;

the sleeve further including a flange portion at another end of the sleeve, a shoulder of another subassembly abutting against the flange portion for capturing the another subassembly while allowing movement of the another subassembly in the sleeve;

each subassembly center conductor including a portion of an electrical contact configured to engage with another portion of an electrical contact and form a center conductor for the adaptive connector, the portions of the electrical contact being configured to slide relative to each other for forming a sliding electrical contact when the adaptive connector varies in length for maintaining an electrical signal path through the center conductor for the adaptive connector between the first and second components.

9. The electrical system of claim 8 wherein each subassembly of the adaptive connector includes an interface portion, the interface portion of one of the subassemblies configured to receive the interface portion of another of the subassemblies for providing an alignment between portions of the sliding electrical contact.

10. The electrical system of claim 8 wherein the sliding electrical contact of the adaptive connector includes a pin portion and a socket portion to receive the pin portion, the socket portion associated with one of the subassemblies and the pin portion associated with another of the subassemblies to slide relative to the socket portion when the adaptive connector varies in length.

11. The electrical system of claim 8 wherein each termination portion of an adaptive connector subassembly forms at least one of a male connector portion or a female connector portion for interfacing with the respective connectors of the components, each subassembly including a center conductor that forms at least one of a pin or a socket to match a male connector portion or a female connector portion.

12. The electrical system of claim 8 wherein each termination portion of an adaptive connector subassembly forms an SMPS connector portion.

13. The electrical system of claim 8 wherein each subassembly of the adaptive connector includes a body portion forming the connector portion and an insert portion containing the center conductor, the body portion of a subassembly configured for receiving the insert portion to present the center conductor with the connector portion at an end of the adaptive connector.

14. The electrical system of claim 13 wherein the insert portion presents the center conductor with the connector portion at an end of the connector in a coaxial arrangement.

* * * * *